United States Patent [19]

Krupp

[11] 4,085,946

[45] Apr. 25, 1978

[54] WHEEL CHAIR CONVERTER

[76] Inventor: Leon B. Krupp, 4800 N. Stanton, El Paso, Tex. 79902

[21] Appl. No.: 762,872

[22] Filed: Jan. 27, 1977

[51] Int. Cl.[2] ..... A61G 15/00

[52] U.S. Cl. ..... 280/289 WC; 297/398; 297/DIG. 4

[58] Field of Search ... 280/289 WC, 289 R, 242 WC; 180/DIG. 3; 297/394, 397, 398, 400, DIG. 4

[56] References Cited

U.S. PATENT DOCUMENTS

| | | | |
|---|---|---|---|
| 2,534,009 | 12/1950 | Freasier et al. | 297/398 |
| 2,990,008 | 6/1961 | Bien | 297/397 |
| 3,084,978 | 4/1963 | Johansson | 297/397 |

*Primary Examiner*—Joseph F. Peters, Jr.
*Assistant Examiner*—Donn McGiehan
*Attorney, Agent, or Firm*—W. Edward Johansen

[57] ABSTRACT

The present invention is a wheel chair converter for use in combination with a wheel chair having a frame with a seat member, a back member and side members, a pair of large rear wheels and a pair of small front wheels to convert the wheel chair to a dental chair. The wheel chair converter includes a back rest and head rest assembly and a rectangular plate member which is mechanically coupled to the back rest and head rest assembly and which is adapted to laterally span the back member of the wheel chair. The wheel chair converter also includes a pair of tubular members and a second pair of tubular members which slideably join together to form a pair of telescoped tubular members which are disposed parallel to each other and secured by the rectangular plate member disposed orthogonal thereto. The tubular members have L-shaped portions each of which has one leg parallel to and adjacent to its straight portion and its other leg disposed at an angle to its straight portion such that its other leg is perpendicular thereto. A pair of small wheels which are mechanically coupled to an axial member are mechanically coupled to the other legs of both L-shaped portions of the tubular members to form a transporting device. The wheel chair converter is placed behind the wheel chair with the back rest and head rest assembly placed in back of the seat member. The wheel chair converter is secured to the frame of the wheel chair by a pair of attaching cords and a belt assembly.

3 Claims, 4 Drawing Figures

Fig. 1
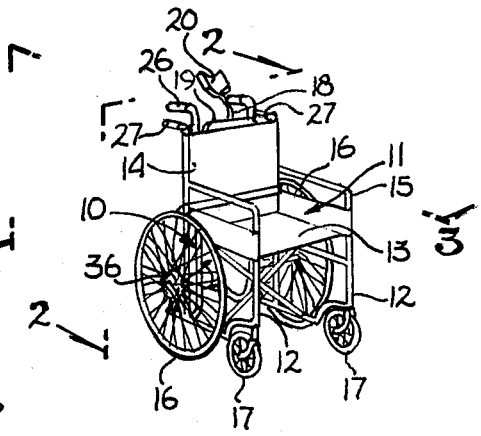
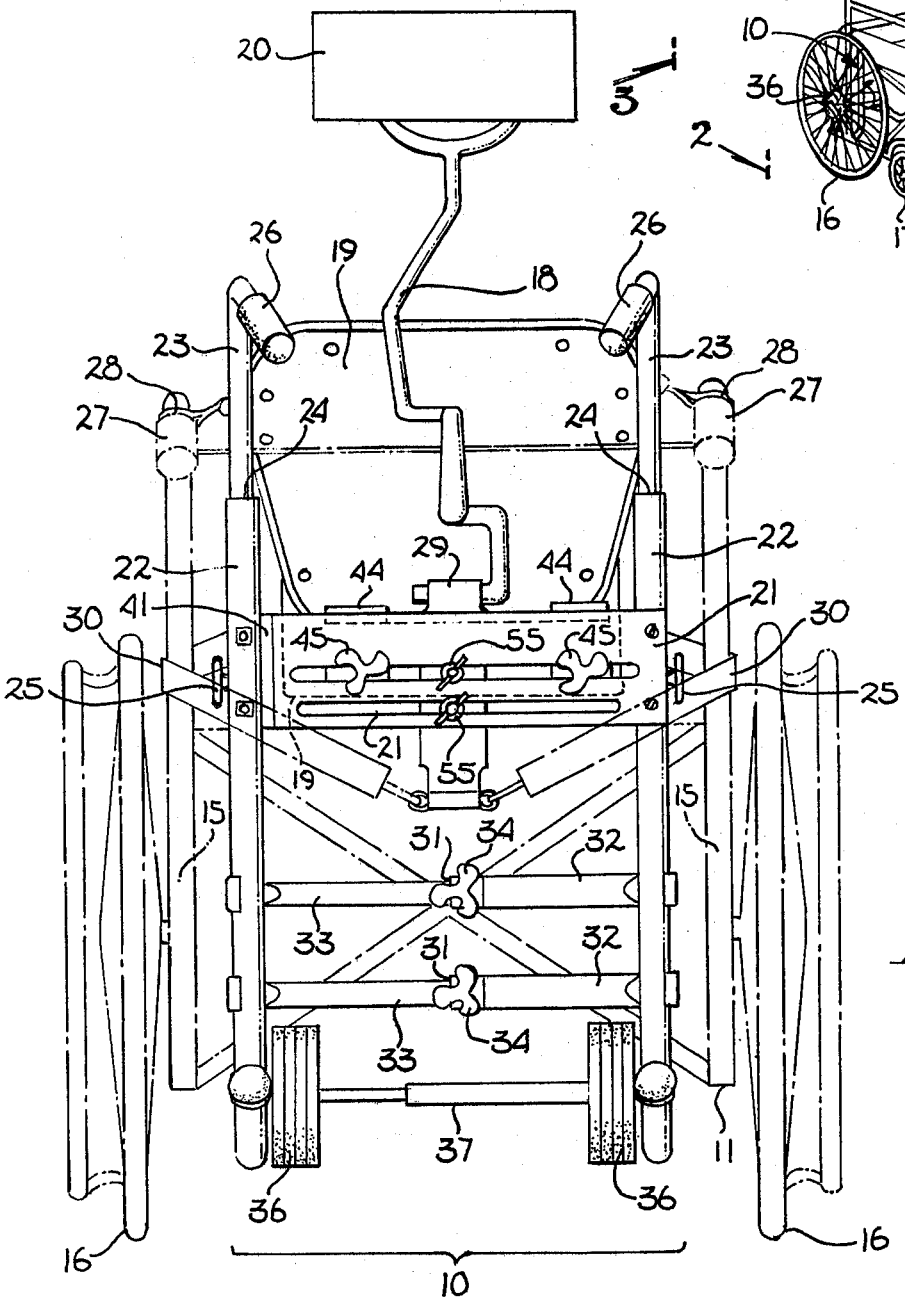
Fig. 2

WHEEL CHAIR CONVERTER

BACKGROUND OF THE INVENTION

1. Field of the Invention

The present relates to dental chairs and wheelchairs and more particularly, to a converter which converts a wheelchair to a dental chair.

2. Description of the Prior Art

There are presently attachments for wheelchairs which convert them to walkers and which hold trays on which the occupants may eat. These attachments generally are formed of similar materials as the wheelchairs. U.S. Pat. No. 3,708,182, entitled Combination Wheel Chair and Walker, issued to Henry Markiel on Jan. 2, 1973, teaches a walker and wheel chair combination in which the walker is made up of a single wheel supported by a U-shaped frame which is attached to the front legs of a wheel chair. Thus a person sitting in the wheel chair can rise to his feet, support himself on the walker and walk.

The wheel chairs themselves are also being improved as in U.S. Pat. No. 3,881,773, entitled Reclining Back Wheelchair, issued to Keith S. Rodaway on Mar. 6, 1975 which provides in combination with a frame structure supporting a seat, a reclining back assembly that includes a back rest pivoted at a point to the frame structure for movement from an upright position to a reclining position, an adjusting tube pivoted at one end at a second pivot point to the back rest, a guide for slideably engaging the other end of the adjusting tube and pivoted at a third pivot point to the frame structure, actuating linkage and a pawl member coupled to the actuating linkage, and in conjunction with which supports the back rest.

U.S. Pat. No. 3,790,212, entitled Foot Support for Wheelchairs, issued to Shigemitsu Suyetani on Feb. 5, 1974, teaches a leg rest arrangement for wheelchairs of the type in which a foot rest is pivotally mounted on a supporting member and moveable from a foot rest position to a closed position. There is provided a leg support spaced vertically from the foot rest for supporting the back of the leg of the user when the foot is resting on the foot rest. The support is operatively connected with the foot rest so that when the foot rest is pivoted to the closed position the leg support is also pivoted to the closed position and is compactly and closely adjacent to the foot rest in the closed position.

There have been improvements to dental chairs during recent years. U.S. Pat. No. 3,948,559, entitled Adjustable Chair, issued to Barry A. Hain and Ronald C. Webb on Apr. 6, 1976, teaches an adjustable chair in combination a base having an upper portion movable vertically relative to the lower portion thereof, a seat unit supported upon the upper portion for direct vertical movement therewith. U.S. Pat. No. 3,968,990, entitled Dental Patient's Chair Including Padded Backrest, issued to Erich Heubeck on July 13, 1976 teaches a dental patient's chair wherein a padding-supporting portion includes a rigid carrier or support frame having fastened to the side remote from the padding cover a unitary shaped element covering the rearwardly facing surface of the backrest, and which is exteriorly provided with a washable surface.

Other improvements to dental chairs in recent years include include those taught in U.S. Pat. No. 3,934,928, U.S. Pat. No. 3,934,929 and U.S. Pat. No. 3,934,931. U.S. Pat. No. 3,934,928, entitled Adjustable Operatory Chair, issued to Phillip C. Johson on Jan. 27, 1976, teaches a device for positioning the backrest of an operatory chair. U.S. Pat. No. 3,934,929, entitled Adjustable Dental Chair, issued to Azriel Jay Rabinowitz on Jan. 27, 1976, teaches articulation of the backrest, seat and footrest which is accomplished by a single motor. U.S. Pat. No. 3,934,931, entitled Dental Chair, issued to Takahiro Matsui and Osamu Uwamori on Jan. 27, 1976, teaches a dental chair with a back attached to the seat so as to be inclinable relative to the seat. All of the above cited patents are concerned with providing comfort to both the dentist and his patients. None of these patents describe a wheel chair converter which can convert a wheel chair to a dental chair so that a patient confined to a wheel chair can receive not only dental treatment comfortably, but also efficiently, because the dentist will be operating in a somewhat similar manner on this patient as he does for his other patients.

The need for a wheel chair converter that provides control, movement, and mobility of the patient for the dentist exists because the patient's head must be stabilized so that a proper examination, diagnosis and definitive treatment may be instituted by the dentist.

SUMMARY OF THE INVENTION

In view of the foregoing problems and conditions characteristic of the prior art, it is a primary object of the present invention to provide a wheel chair converter that converts a wheel chair immediately to a dental chair.

It is another object of the present invention to provide a wheel chair converter which is secured by the attachment of attaching cords, a belt or other simple hardware so that the components of the wheel chair and the wheel chair converter become an integrated entity.

It is still another object of the present invention to provide a wheel chair converter which when coupled to a wheel chair will stabilize the head of the person confined in the wheel chair so that the dentist can institute a proper examination, diagnosis, and definitive treatment of the person's dental problem.

It is yet another object of the present invention to provide a wheel chair converter which provides comfort during the dental operation to both the dentist, and his patient who is confined to a wheel chair.

It is yet still another object of the present invention to provide a wheel chair converter which enables the dentist to easily position and maintain the head position of his wheel chair confined patient during the dental operation.

In accordance with an embodiment of the present invention a wheel chair converter for converting a wheel chair to a dental chair has been described. The wheel chair has a frame which includes a seat member, a back member, and side members, a set of large rear wheels and a set of small front wheels. The wheel chair converter includes a back rest and head rest assembly and a rectangular plate member which is mechanically coupled to the back rest and head rest assembly and which is adapted to laterally span the back member of the wheel chair. The wheel chair converter also includes a first pair of tubular members and a second pair of tubular members, which are mechanically coupled together so that the second pair of tubular members telescopes into the first pair of tubular members, with both pairs of tubular members being parallel to each other and mechanically coupled together by the rectangular plate member. The wheel chair converter further includes a pair of L-shaped tubular members mechanically coupled to the first pair of tubular members, each L-shaped tubular member having one of its legs disposed adjacent to and parallel to one of the first pair of tubular members and its other leg disposed perpendicular to the tubular member such that its other leg is parallel to the ground when the wheel chair converter is coupled to the wheel chair and a transporting device coupled to the pair of L-shaped tubular members which has an axial member mechanically coupled to the ends of the other legs of the L-shaped tubular members and a pair of small wheels mechanically coupled to the axial member. The wheel chair converter is placed on the wheel chair with the back rest and head rest assembly disposed in back of the wheel chair and the first and second pairs of tubular members disposed in back of the seat member and secured there by a belt member securing it to the frame and back of the wheel chair and by a pair of attaching cords thereby securing it to the side members of the wheel chair.

The features of the present invention which are believed to be novel are set forth with particularity in the appended claims.

Other objects and many of the attendant advantages of this invention will be more readily appreciated as the same becomes better understood by reference to the following detailed description and considered in connection with the accompanying drawing in which like reference symbols designate like parts throughout the figures.

DESCRIPTION OF THE DRAWING

FIG. 1 is a perspective view of a wheel chair coupled to a wheel chair converter, which is constructed in accordance with the principles of the present invention, converting it to a dental chair.

FIG. 2 is a rear elevational view of the wheel chair coupled to the wheel chair converter of FIG. 1 along lines 2—2.

DESCRIPTION OF THE PREFERRED EMBODIMENT

Figure 4:
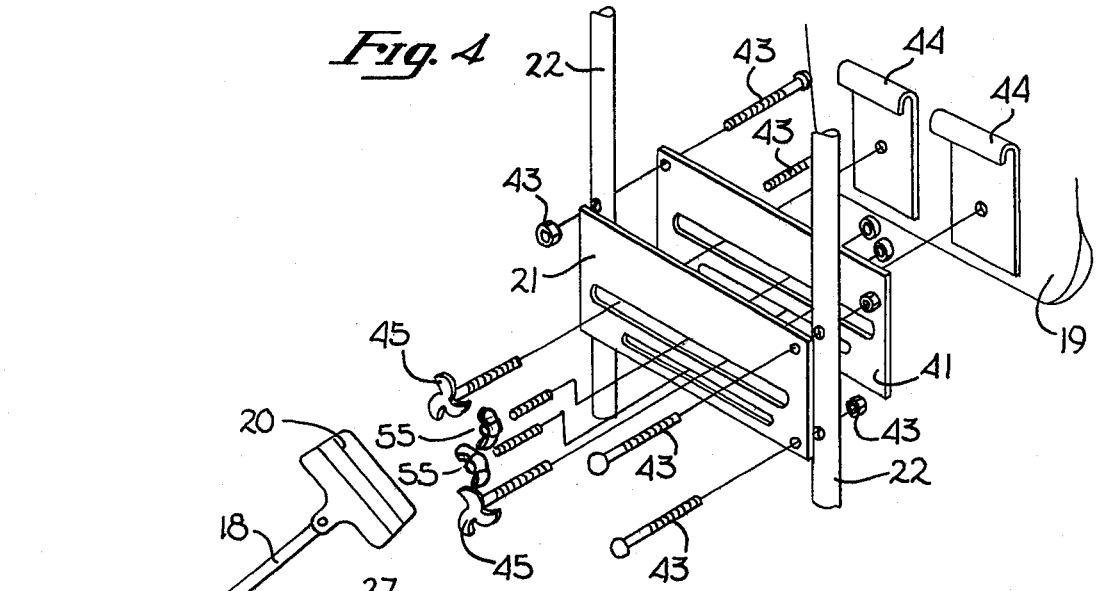
FIG. 4 is a perspective view of a pair of rectangular plate members and a pair of tubular members of the wheel chair converter of FIG. 2 for securing a back rest and a head rest assembly.
Figure 3:
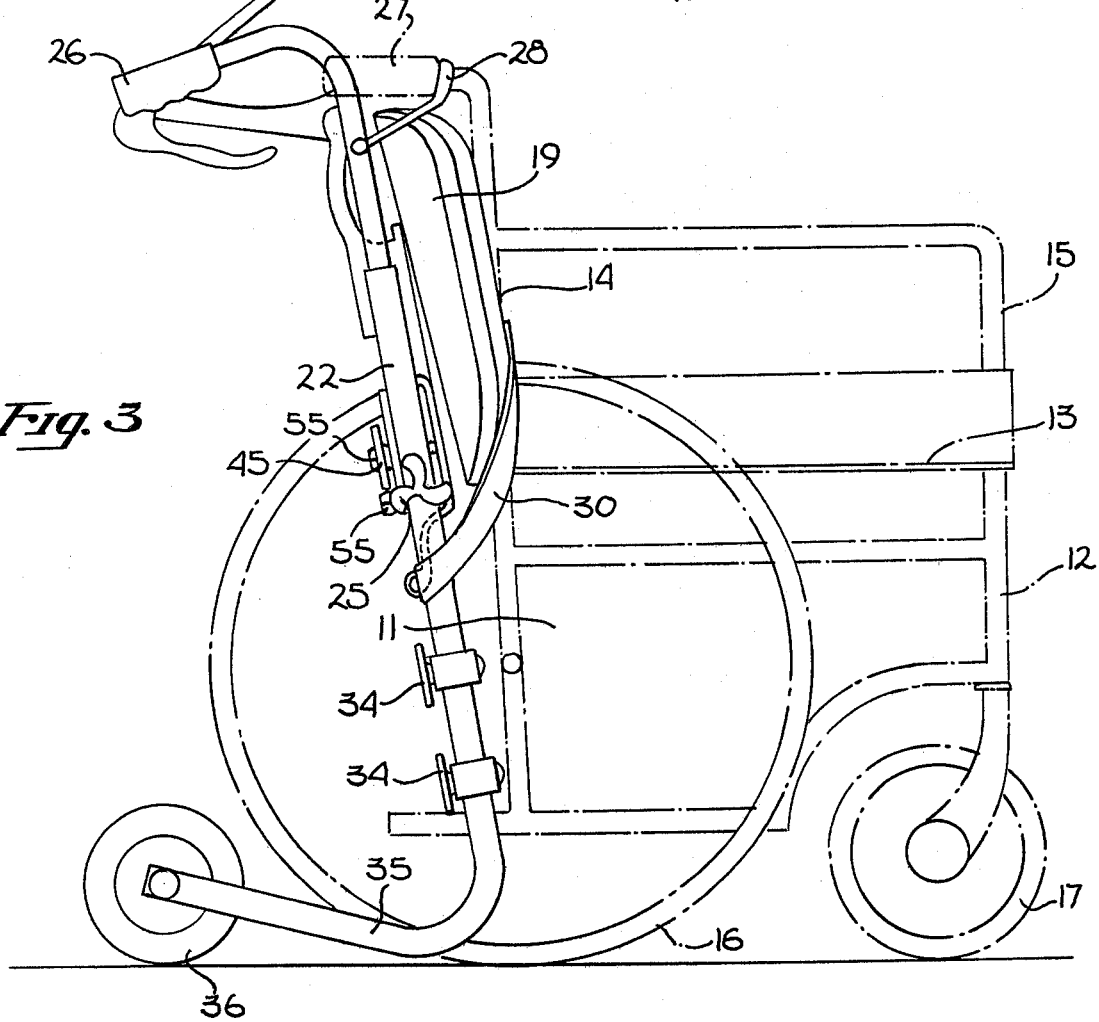
FIG. 3 is a side elevational view of the wheel chair coupled to the wheel chair converter of FIG. 1 along lines 3—3.

The present invention can best be understood by referring to a description of its preferred embodiment. The preferred embodiment of the present invention is a wheel chair converter 10 shown in combination with a wheel chair 11 in FIG. 1. The wheel chair 11 includes a frame 12 having a seat member 13, a back member 14 and side members 15, a set of large rear wheels 16 coupled to the frame 12 and a set of small front wheels 17 coupled to the frame 12. The wheel chair converter 10 includes a head rest assembly 18, a back rest 19, and a head rest 20 which is mechanically coupled to the head rest assembly 18.

The inventor is using a conventional back rest 19 manufactured by the Ritter Dental Manufacturing Company and a head rest assembly 18 in his wheel chair converter similar to one in which U.S. Pat. No. 2,062,592, entitled Headrest Supporting Means, issued to Adam J. May in Dec. 1, 1936, assigned to Ritter Dental Manufacturing Company, now the Ritter Company, Inc., teaches a head rest supporting structure which is adaptable to a variety of dental chairs. The back rest 19 and the head rest assembly 18 is also similar to those sold by the Ritter Company, Inc. The head rest 20 used in the preferred embodiment is taught in U.S. Pat. No. 2,586,952, entitled Headrest, issued to Carroll W. Johnson and John T. Clark on Feb. 26, 1952, and assigned to the Weber Dental Manufacturing Company.

Referring now to FIG. 2 the wheel chair converter 10 also includes a first rectangular plate member 21, a first pair of tubular members 22 of a certain diameter and a second pair of tubular members 23 of a diameter smaller than the certain diameter of the first pair of tubular members 22. Each of the first pair of tubular members 22 has one of the second pair of tubular members 23 telescoped into it to form a pair of telescoped tubular members 24. The first rectangular plate member 21 secures the pair of telescoped tubular members 24 parallel to each other and orthogonal to itself.

The pair of telescoped tubular members 24 are adjustable in that the first pair of tubular members 22 and the second pair of tubular members 23 are slideably joined together and are secured by a pair of wing screws 25. Each of the second pair of tubular members 23 has a handle 26 attached to it. The wheel chair 11 also includes a pair of handles 27 attached to the side members 15 of the frame. An attaching cord 28 coupled to each of the second pair of tubular members 23 and then coupled to each handle 27 of the wheel chair 11 secures the wheel chair converter 10 to the wheel chair 11.

Still referring to FIG. 2 the rear portion of the back rest 19 and the head rest assembly 18 can be seen. It can be noted that the rear of this assembly 18 includes a mounting member 29 which is secured to the first rectangular plate member 21. Also coupled to the mounting member 29 is a belt assembly 30 which secures the wheel chair 11 to the converter 10. The wheel chair converter further incudes a second pair and a third pair of telescoped tubular members 32, which are placed horizontally and are of a specific diameter, and a fourth pair and a fifth pair of tubular members 33 of a smaller diameter than the specific diameter of the second and third pair of tubular members 32 each of which pair is adapted to slideably join into the second and third pairs of tubular members 32. Each of these pairs of the telescoped tubular members 32 is mechanically coupled to one of the second and third pairs of telescoped tubular members 33 and disposed orthogonal thereto and parallel to each other. These telescoped tubular members 32 are secured be a pair of wing screws 34 and provide rigidity to the wheel chair converter 10.

Referring now to FIG. 4 in conjunction with FIG. 2 the wheel chair converter 10 also includes a second rectangular plate 41 which is secured to the first pair of parallel tubular members 22 in conjunction with the first rectangular plate 21 to which it is disposed parallel and adjacent. Both the first and second rectangular plates 21 and 41 are secured by a set of two bolts and nuts 43. Plate 21 is secured to tubular member 22 unilaterally on only the right end—the left end is not attached—FIG. 4.

Plate 41 is secured to the tubular member 22 also unilaterally only on the left end. The right end is not attached. FIG. 4.

Such unilateral attachment provides for horizontal contractions or expansions. Reference orientation for this description is as viewed from rear of chair converter.

A pair of L-shaped brackets 44 are secured to the first and second rectangular plates 21 and 41 by a pair of wing nuts and bolts 45 which secures the back rest. The back rest assembly 19 is mechanically coupled to the L-shaped brackets 44 by bolts 45 carried through the rectangular plates 41 and 21 of FIG. 4. The back rest assembly 19 is secured horizontally by the two nuts and bolts 45 only in the top plate slits.

The head rest assembly 18 is secured independently by two nuts and wing bolts 55 placed vertically and carry through the mounting member 29 and thence through the two horizontal slits of rectangular plates 21 and 41. Such attachment provides for centering of assembly 18 when there is a desire for lateral changes of plates 21 and 41.

The wheel chair converter 10 converts a wheel chair 11 to a dental chair to enable the dentist to provide proper treatment to a wheel chair patient. The back rest 19 and the head rest assembly 18 including the mounting member 29 is placed behind the back mamber 14 of the wheel chair 11. The wheel chair converter 10 is secured to the frame 12 of the wheel chair 11 by the attaching cords 28 and the belt assembly 30. The small wheels 36 are provided so that the dental chair may be easily moved, but these wheels are not necessary for the invention to operate.

From the foregoing it can be seen that a wheel chair converter for converting a wheel chair into a dental chair has been described. The wheel chair converter includes two parallel tubular members which are held in place by a set of orthogonal members and a back rest and head rest assembly secured to the orthogonal members. The preferred embodiment of the wheel chair converter has a set of small wheels 36 on which it may be easily moved when it has converted a wheel chair to a dental chair. The axle component upon which the wheels are placed also embodies the principle of telescoping, providing for lateral expansion or contraction if desired. A wing set bolt is provided on the tubular segment. The wheel chair converter is adaptable and adjustable to fit any size of wheel chair.

It should be noted that the schematics of the wheel chair converter are not drawn to scale and that the distances of and between figures are not to be considered significant.

Accordingly, it is intended that the foregoing disclosure and showings made in the drawing shall be considered only as illustrations of the principles of the present invention.

What is claimed is:

1. For use in combination with a wheel chair having a frame which includes a seat member, a back member, and side members, a set of large rear wheels and a set of small front wheels, a wheel chair converter, for converting the wheel chair to a dental chair, comprising:

a. a back rest and head rest assembly;

b. a rectangular plate member which is mechanically coupled to said back rest and head rest assembly, said rectangular plate adapted to span the back member of the frame of the wheel chair laterally;

c. a pair of tubular members which are disposed parallel to each other and which are mechanically coupled together by said rectangular plate, said tubular members are placed behind the back member of the wheel chair; and d. a pair of backwardly extending legs, each of which is mechanically coupled to one of said pair of tubular member so that each of said legs is disposed substantially perpendicular thereto in order to stabilize said wheel chair converter.

2. For use in combination with a wheel chair having a frame which includes a seat member, a back member, and side members, a set of large rear wheels and a set of small front wheels, a wheel chair converter, according to claim 1 wherein said wheel chair converter also comprises securing means for securing said wheel chair converter to the wheel chair.

3. For use in combination with a wheel chair having a frame which includes a seat member, a back member, and side members, a set of large rear wheels and a set of small front wheels, a wheel chair converter, according to claim 1 wherein said wheel chair converter also comprises a pair of telescoping tubular members mechanically coupled to said pair of tubular members, which are disposed parallel to each other, said pair of telescoping tubular members are disposed parallel to each other and perpendicular to and adjacent to said tubular members.

* * * * *